United States Patent [19]

Rifat

[11] 4,373,478

[45] Feb. 15, 1983

[54] APPARATUS FOR RELEASABLY SECURING IGNITION DEVICES

[76] Inventor: Sultan A. Rifat, 159 Gelston Ave., Brooklyn, N.Y. 11209

[21] Appl. No.: 258,023

[22] Filed: Apr. 27, 1981

[51] Int. Cl.[3] ..... F02P 13/00

[52] U.S. Cl. ..... 123/169 R; 123/193 H; 123/195 A

[58] Field of Search ..... 123/169 PA, 169 R, 169 EC, 123/195 A, 195 C, 198 E, 193 H, 470, 273

[56] References Cited

U.S. PATENT DOCUMENTS

| | | | |
|---|---|---|---|
| 1,848,065 | 3/1932 | Rabezzana | 123/169 R |
| 3,110,297 | 11/1963 | Kauffmann et al. | 123/169 R |
| 3,747,583 | 7/1973 | Spengler et al. | 123/169 EC |

FOREIGN PATENT DOCUMENTS

| | | | |
|---|---|---|---|
| 608973 | of 1948 | United Kingdom | 123/169 R |

*Primary Examiner*—Charles J. Myhre
*Assistant Examiner*—Andrew M. Dolinar
*Attorney, Agent, or Firm*—Hubbell, Cohen, Stiefel & Gross

[57] ABSTRACT

Improved apparatus (10) for releasably securing a plurality of non-externally threaded ignition devices (12) in cylinder head bores (29) for facilitating the insertion and removal of the ignition devices therefrom, the apparatus (10) comprising means (20) defining a pair of slots (30) about each bore (29); a retaining member (22) for each ignition device (12) having a bearing surface (44) and a pair of projections (42) receivable in a pair of slots (30); and means for releasably securing the projections (42) in the slots (30) with the bearing surfaces (44) abutting the ignition devices (12) for urging them into their respective bores (29).

8 Claims, 10 Drawing Figures

APPARATUS FOR RELEASABLY SECURING IGNITION DEVICES

TECHNICAL FIELD

This invention pertains to apparatus for use with combustion engines for releasably securing the ignition devices thereof in place, and more particularly to apparatus of the type described wherein the ignition devices are retained in the cylinder head other than by complementary threaded surfaces.

BACKGROUND ART

Ignition devices, such as spark plugs, are conventionally retained in bores in the cylinder head by complementary threads on the plugs and bores. This arrangement is disadvantageous in view of the time required for removing and resetting the plugs, especially in multiple cylinder engines. It is also necessary to exercise care when resetting the plugs, because if they are tightened too much, the threads in the cylinder head bores may wear out, resulting in a loss of compression and expensive repairs. This may also result if the plugs are tightened at an improper angle, which is not uncommon when the bores are difficult to reach.

The prior art discloses certain alternatives to the use of complementary threads. U.S. Pat. No. 2,393,359 issued to Fink discloses one such arrangement wherein the ignition devices are screwed into a manifold which is releasably secured to the cylinder head. As a result, all the ignition devices may be simultaneously removed from their respective bores by removing the manifold from the cylinder head. However, each ignition device must still be individually unscrewed from the manifold to effect replacement or cleaning. U.S. Pat. No. 3,747,583 issued to Spengler, et al. discloses an arrangement wherein each ignition device comprises an inner portion having a profile which releasably mates with a corresponding profile in an outer or sleeve portion. The sleeve portion seats in the cylinder head bore and is retained therein by complementary threads. This arrangement is disadvantageous in that a specially designed tool is required to effect insertion and removal of the inner portion of the ignition device from its sleeve. U.S. Pat. No. 1,848,065 issued to Rabezzana discloses an arrangement wherein the outer shell of the ignition device is tapered for a force fit in a correspondingly tapered bore in the cylinder head. However, the means disclosed in this patent for securing the ignition devices in place, which comprises a fulcrum member releasably secured to the cylinder head by a nut and bolt, does little to minimize the time required to insert and remove the ignition devices.

DISCLOSURE OF THE INVENTION

I have invented an improved apparatus for releasably securing a plurality of non-externally threaded ignition devices in corresponding bores in the cylinder head. The preferred apparatus according to the invention includes a frame securable to the cylinder head, the frame having a plurality of openings in alignment with the cylinder head bores. A plurality of slotted lugs extend upwardly from the frame such that a pair of lugs is diametrically opposed about each of the bores.

The preferred apparatus further includes a plurality of retaining members, one for each ignition device, each retaining member having a bearing surface and a pair of projections receiveable in the slots in a pair of opposed lugs. The retaining member is configured such that when the projections thereof are received in the slots in the lugs, rotation of the retaining member over the top of the ignition device establishes a camming action which urges the ignition device downward until the bearing surface abuts and firmly seats and locks the ignition device in its respective bore in the cylinder head. The ignition device is removed by simply rotating the retaining member in the reverse direction whereupon the retaining member may be disengaged from the lugs and the ignition device extracted.

To minimize the possibility of compression loss, each cylinder bore is preferably stepped to define a pair of radially extending shoulders, and each ignition device is complementary in shape. Annular gaskets are preferably inserted into the bores for seating on the shoulders such that when the ignition devices are urged into the bores by the retaining members, the gaskets are compressed thereby providing a seal to prevent the escape of gases from the piston chambers. The gaskets are preferably comprised of non-combustible and resilient material, many such materials being known to those skilled in the art.

The arrangement according to the present invention eliminates the need for tools to insert and remove the ignition devices. The possibility of damaging the bores by applying too much pressure on the ignition devices is also eliminated, as the dimensioning of the retaining members results in a specific and consistent pressure on the ignition devices.

Further features and advantages of the apparatus in accordance with the present invention will be more fully apparent from the following detailed description and annexed drawings of the presently preferred embodiments thereof.

BRIEF DESCRIPTION OF THE DRAWINGS

In the drawings:

FIGS. 4A–4D are elevational views illustrating the manner of utilizing the preferred apparatus for releasably securing an ignition device in place;

BEST MODE FOR CARRYING OUT THE INVENTION

Figure 1B:
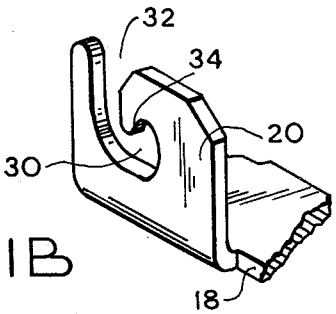
FIG. 1B is a fragmentary perspective view detailing part of the apparatus of FIG. 1A.
Figure 1A:
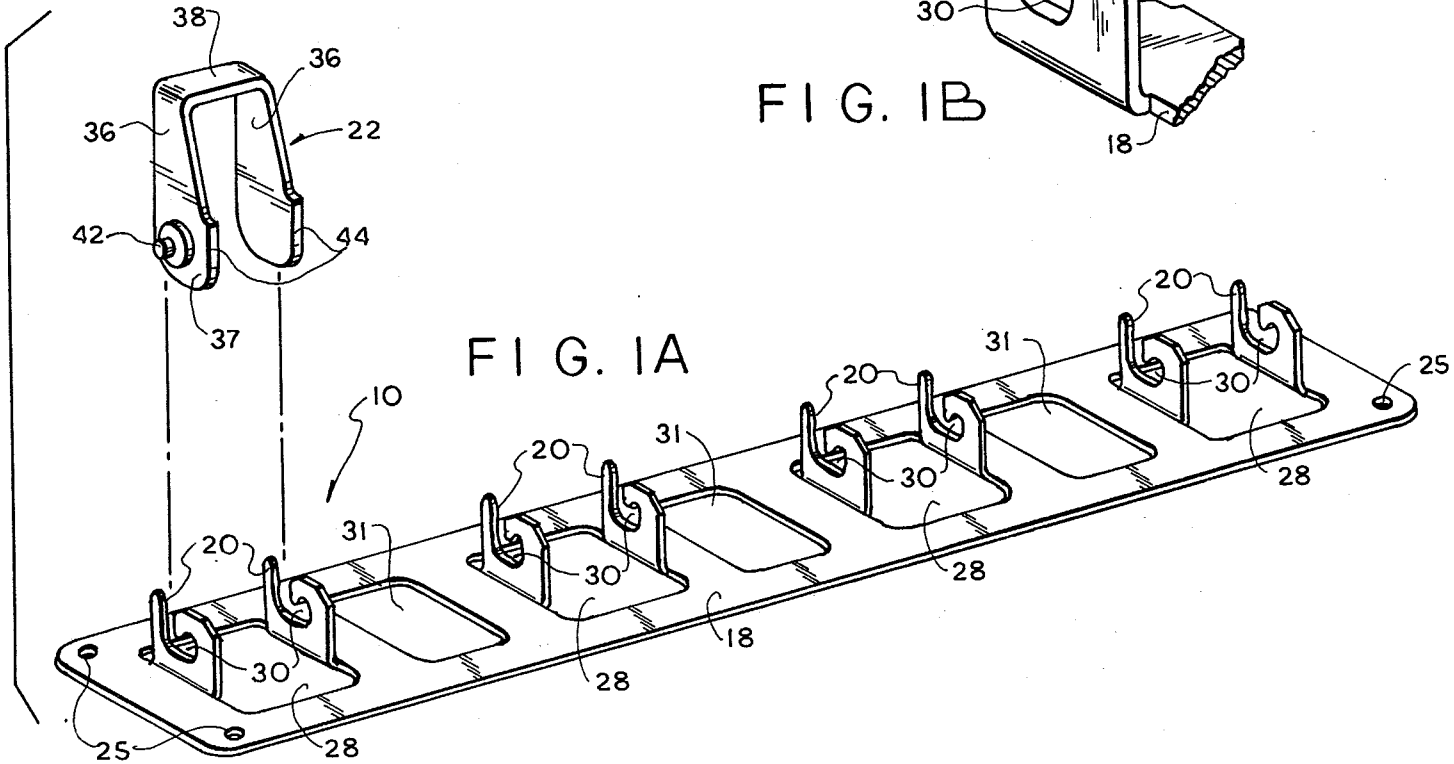
FIG. 1A is a perspective view illustrating the preferred apparatus in accordance with the present invention for releasably securing a plurality of ignition devices in place in a multiple cylinder engine.
Figure 2:
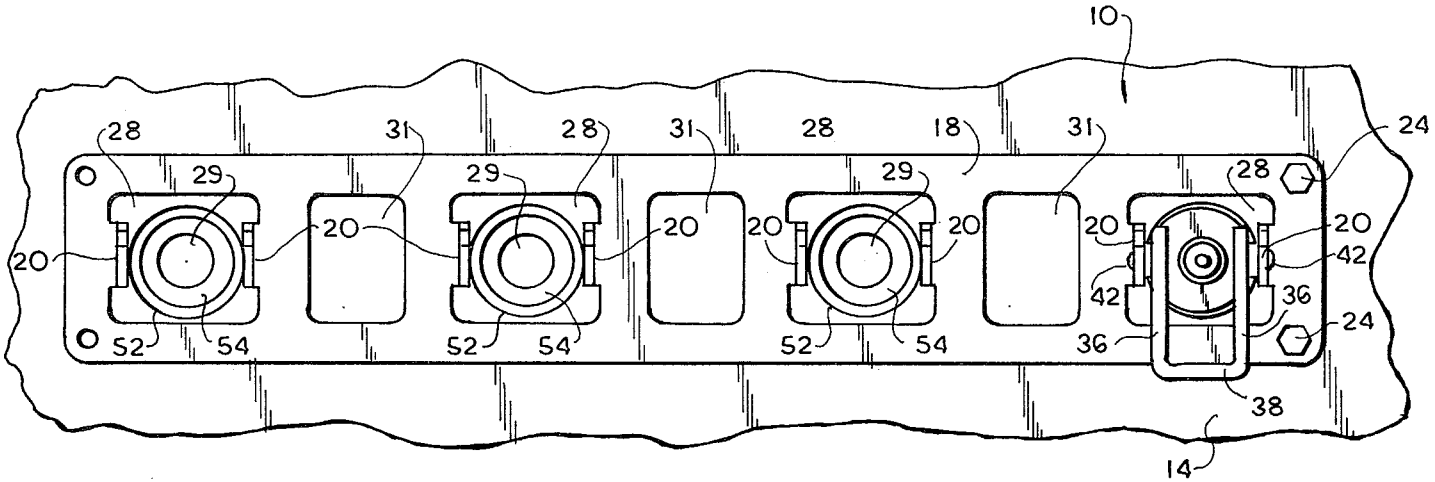
FIG. 2 is a top plan view of the preferred apparatus as mounted on one side of the cylinder head of an eight cylinder engine.
Figure 3:
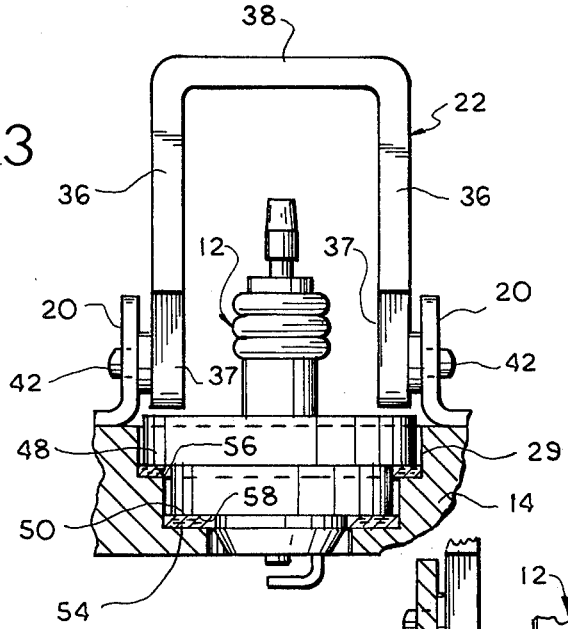
FIG. 3 is an elevational view showing one ignition device in place.

Referring now to the drawings, and initially to FIGS. 1–3 thereof, the preferred apparatus for releasably securing the ignition devices 12 in the cylinder head 14 is generally designated by the reference numeral 10. As shown, the apparatus 10 comprises a frame 18 having a plurality of preferably integral upstanding lugs 20, and a plurality of retaining members 22. The frame 18 and retaining members 22 are preferably comprised of a metal or metal alloy of the type conventionally used in cylinder heads.

In FIG. 2, the apparatus 10 is shown on only one side of the cylinder head 14 of a conventional V-8 internal combustion engine, although it will be appreciated that an apparatus identical to that illustrated is preferably secured to the other side of the cylinder head 14 as well. As this description progresses, it will be apparent to those skilled in the art that the configuration of the apparatus 10 illustrated in FIGS. 1 and 2 may be modified for use with engines having other configurations as well.

The frame 18 may be secured to the cylinder head 14 as by bolts 24 extending through holes 25 in the frame, only some of the bolts being shown in FIG. 2. A plurality of openings 28 are provided in the frame 18 such that one opening 28 overlies each of the bores 29 which receive the ignition devices 12. The remaining openings or punch outs 31 are optional and are included solely to minimize the material required to fabricate the frame 18. As shown, the lugs 20 extend upwardly from the frame 18 such that a pair of lugs is diametrically opposed about each of the bores 29. As best illustrated in FIG. 1B, each lug 20 has a preferably serpentine slot 30 therein, each slot having an open end 32 and a closed end 34.

Each retaining member 22 preferably includes a pair of legs 36 having generally rounded corners at the free ends 37 thereof, the legs being connected by a cross piece 38. A pin or projection 42 extends outwardly from each of the ends 37 off-center thereof (FIG. 4), the pins 42 being dimensioned for reception in the slots 30.

Figures 4, 4B, 4C, 4D:
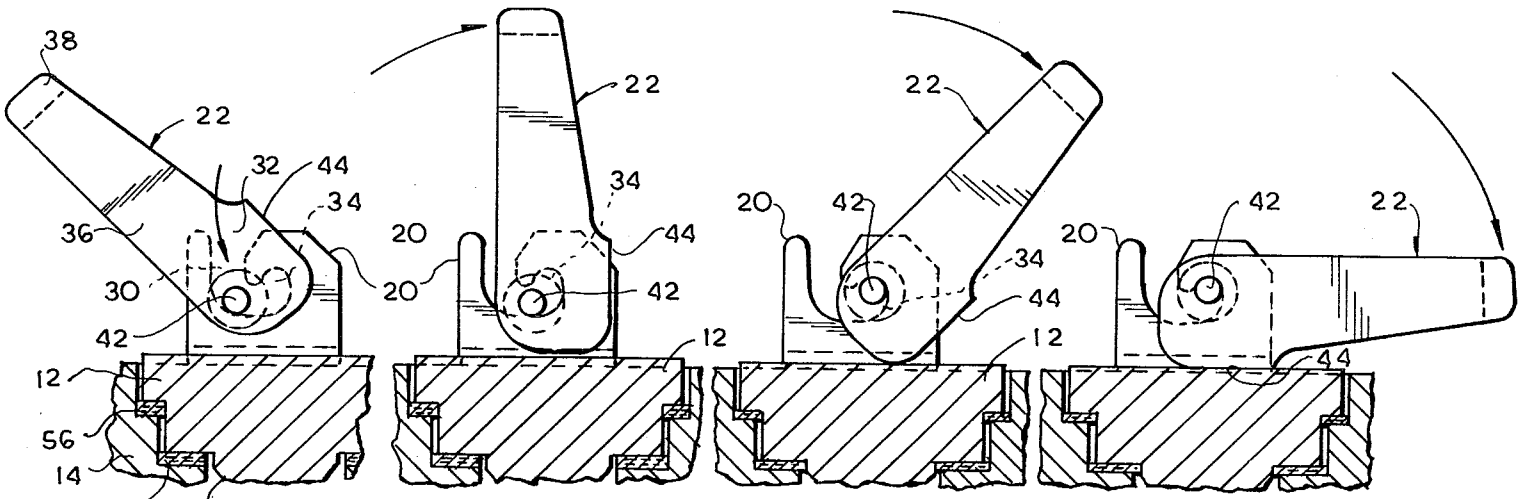

As best shown in FIGS. 3 and 4, the apparatus 10 of the present invention is intended for use with non-externally threaded ignition devices 12. An exemplary non-externally threaded ignition device 12 usable with the present invention is illustrated in the drawings, although as this description progresses those skilled in the art will recognize that the invention may be used with non-externally threaded ignition devices having other configurations as well. As shown in FIGS. 3 and 4, the ignition device 12 may be conventional except for the elimination of the normal external threads and the provision of two shoulders 48, 50 which are complementary to a corresponding pair of shoulders 52, 54 formed in the bores 29 in the cylinder head 14. As will be more fully apparent hereinafter, to prevent a loss of compression when the ignition devices 12 are secured, a pair of preferably annular gaskets 56, 58 are seated on the shoulders 52, 54 in the cylinder head bores 29.

Referring now to FIGS. 1–4, the procedure for releasably securing an ignition device 12 in its respective bore 29 in the cylinder head 14 will be described. Initially, the gaskets 56, 58 are seated on the shoulders 52, 54, respectively. The projections 42 of the retaining member 22 are then slid into the open ends 32 of the slots 30 in the corresponding pair of lugs 20 (see FIGS. 3 and 4A). Referring to FIG. 4, the member 22 is then rotated in a clockwise direction, preferably by gripping the crosspiece 38.

As clockwise rotation proceeds, the retaining member 22 inherently moves to the right as viewed in FIG. 4, until the projections 42 are aligned with the closed ends 34 of the slots 30 (see FIGS. 4A–4C). At the same time, and as a result of the projections 42 extending off-center from the ends 37 of the legs 36, the peripheries of the ends 37 eventually contact the ignition device 12. At this point, a camming action is established between the ignition device 12 and the ends 37, the camming action serving to urge the projections 42 upward into abutment with the closed ends 34 of the slots 30 (FIG. 4C). With the projections 42 in this position, further upward movement of the retaining member 22 is blocked. Consequently, as rotation of the retaining member 22 is continued to its final position (FIG. 4D), the continued camming action applies downward pressure on the top of the ignition device 12 thereby compressing the gaskets 56, 58 and firmly seating the ignition device 12 in its bore 29 in the cylinder head 14. It will now be apparent that the rounded corners of the ends 37 of the legs 36 facilitate rotation of the retaining member 22 on the top of the ignition device 12.

As shown in FIG. 4D, when the retaining member 22 is in its final position, the flattened sections 44 along the peripheries of the ends 37 are seated on top of the ignition device 12. It will be apparent that when the retaining member 22 is in this position, the ignition device 12 is locked in its respective bore. Thus, the configuration of the cam defined by the member 22 prevents accidental counterclockwise rotation of the retaining member, such as might otherwise be caused by, e.g., rocking motion of the engine. The ignition device 12 is readied for operation by connecting the usual wire (not shown) to the top of the ignition device, it being apparent that the space between the legs 36 of the retaining member 22 accommodates the wire and the portion of the ignition device 12 extending outside the cylinder head 14.

To remove the ignition device 12, as for cleaning or replacement, the crosspiece 38 is gripped and rotated in a counterclockwise direction from the position illustrated in FIG. 4D to the position illustrated in FIG. 4A. The retaining member 22 is then removed. Upon disconnecting the wire, the ignition device 12 may be lifted out of its bore 29 in the cylinder head 14.

It will be apparent that utilization of the apparatus 10 requires very little modification to existing cylinder heads and ignition devices. As regards the cylinder head, apart from the provision of holes 25 to receive the bolts 24 the only other modification is the provision of shoulders 52, 54 in the bores 29. Conventional ignition devices need only be modified by eliminating their external threading and providing the steps 48, 50.

Figure 5:
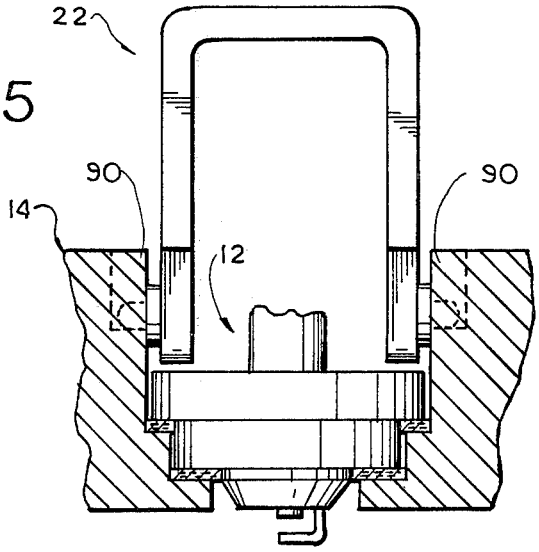
FIG. 5 is a fragmentary view similar to FIG. 3 illustrating a modified arrangement in accordance with the present invention.

Referring now to FIG. 5, a modified arrangement in accordance with the present invention is illustrated. The arrangement shown in FIG. 5 is identical to that of FIGS. 1–4, except that the frame 18 and integral lugs 20 are eliminated, and slots 90 corresponding to the slots 30 are formed in the walls defining the bores 29. It will be apparent from the foregoing that operation of the modified arrangement illustrated in FIG. 5 is the same as that illustrated in FIGS. 1–4.

Figure 6:
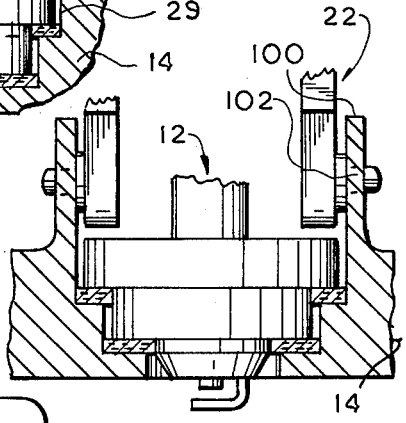
FIG. 6 is a fragmentary view similar to FIG. 3 illustrating a still other modified arrangement in accordance with the invention.

FIG. 6 illustrates a still further modified arrangement in accordance with the present invention. In FIG. 6, the frame 18 and integral lugs 20 are replaced by lugs 100 integrally formed on the upper surface of the cylinder head 14. The lugs 100 are formed with slots 102 which correspond to the slots 30 in FIGS. 1–4 and serve the same function. The construction and operation of the embodiment of FIG. 6 is in all other respects identical to that illustrated in FIGS. 1–4. If desired, lugs 100 may be separately formed and bolted to the cylinder head 14 rather than being integrally formed therewith.

While I have herein shown and described a preferred embodiment of an apparatus in accordance with the present invention and suggested certain modifications thereto, those skilled in the art will appreciate that still further changes and modifications may be made therein without departing from the spirit and scope of the invention. Accordingly, the above description should be construed as illustrative, and not in a limiting sense, the scope of the invention being defined by the following claims.

I claim:

1. Apparatus for use with a combustion engine of the type including a cylinder head having a plurality of bores therein for receiving a plurality of non-externally threaded ignition devices, said apparatus releasably securing said ignition devices in said bores and facilitating the insertion and removal of said ignition devices therefrom, said apparatus comprising:

means, separate from said ignition devices, defining a pair of slots about each of said bores;

a plurality of retaining members, one for each ignition device, each retaining member having a bearing surface and a pair of projections receivable in a pair of slots disposed about a bore; and means for releasably securing said projections in said slots with said bearing surfaces abutting said ignition devices and urging said ignition devices into said bores.

2. The apparatus of claim 1, wherein each retaining member includes a pair of spaced confronting legs joined together at one end, the peripheral surfaces of the free ends of said legs collectively defining said bearing surface; wherein each pair of slots is in diametric opposition about its respective bore; and wherein said releasable securing means comprises said projections extending off center from said free ends, and each slot including a closed end portion extending generally upward relative to said cylinder head, whereby when said projections are received in said slots and said retaining members are rotated, a camming action is established between said bearing surfaces and said ignition devices for urging said projections into abutment with said closed end slot portions and said ignition devices into said cylinder head bores.

3. The apparatus according to claim 2, wherein said slots are opened at the other ends thereof for removal of said projections from said slots.

4. The apparatus according to claim 3, wherein said bearing surfaces include flattened portions which abut said ignition devices when said ignition devices are in their secured positions; and wherein a portion of the remainder of said bearing surfaces is rounded.

5. The apparatus according to claims 1 or 4, wherein said bores are radially stepped to define a shoulder in each, and wherein said ignition devices are shaped complementary to said bores; and further comprising an annular gasket disposable in each of said bores on said shoulder.

6. The apparatus of claim 5, wherein said slot defining means comprises a plurality of lugs operatively secured to said cylinder head and extending upwardly therefrom, there being a pair of lugs disposed about each of said bores, one slot being formed in each lug.

7. The apparatus of claim 5, further comprising a frame member securable to said cylinder head and having a plurality of openings therein in alignment with said bores, said frame member including a plurality of lugs extending upwardly from said cylinder head, there being a pair of lugs disposed about each bore, each lug having a slot therein.

8. The apparatus of claim 5, wherein said slot defining means comprises said cylinder head, a pair of slots being provided in the wall defining each bore.

* * * * *